US005908477A

United States Patent [19]

Harmer et al.

[11] Patent Number: 5,908,477

[45] Date of Patent: Jun. 1, 1999

[54] ABRASIVE ARTICLES INCLUDING AN ANTILOADING COMPOSITION

[75] Inventors: Walter L. Harmer, Arden Hills, Minn.; Don H. Kincaid, Hudson, Wis.; Alan R. Kirk, Cottage Grove; Eric G. Larson, Lake Elmo, both of Minn.

[73] Assignee: Minnesota Mining & Manufacturing Company, St. Paul, Minn.

[21] Appl. No.: 08/881,209

[22] Filed: Jun. 24, 1997

[51] Int. Cl.[6] ..... B24B 1/00; B24D 3/34

[52] U.S. Cl. ..... 51/305; 51/304; 51/306; 51/295; 451/59

[58] Field of Search ..... 51/295, 304–306; 451/59

[56] References Cited

U.S. PATENT DOCUMENTS

| | | | |
|---|---|---|---|
| 1,141,371 | 6/1915 | Virneburg . | |
| 1,687,454 | 10/1928 | Klein et al. . | |
| 2,687,357 | 8/1954 | Fiser | 106/268 |
| 2,958,593 | 11/1960 | Hoover et al. | 51/295 |
| 3,043,673 | 7/1962 | Klein et al. | 51/298 |
| 3,781,172 | 12/1973 | Pett et al. | 51/309 |
| 3,795,496 | 3/1974 | Greenwood | 51/295 |
| 3,849,949 | 11/1974 | Steinhauser et al. | 51/406 |
| 3,891,408 | 6/1975 | Rowse et al. | 51/295 |
| 3,893,826 | 7/1975 | Quinan et al. | 51/295 |
| 3,926,585 | 12/1975 | Lukowski | 51/295 |
| 4,038,046 | 7/1977 | Supkis | 51/295 |
| 4,396,403 | 8/1983 | Ibrahim | 51/295 |
| 4,518,397 | 5/1985 | Leitheiser et al. | 51/293 |
| 4,574,003 | 3/1986 | Gerk | 51/309 |
| 4,609,581 | 9/1986 | Ott | 428/100 |
| 4,652,274 | 3/1987 | Boettcher et al. | 51/298 |
| 4,744,802 | 5/1988 | Schwabel | 51/309 |
| 4,770,671 | 9/1988 | Monroe et al. | 51/293 |
| 4,881,951 | 11/1989 | Wood et al. | 51/309 |
| 4,991,362 | 2/1991 | Heyer et al. | 51/400 |
| 5,011,508 | 4/1991 | Wald et al. | 51/293 |
| 5,025,596 | 6/1991 | Heyer et al. | 51/400 |
| 5,061,294 | 10/1991 | Harmer et al. | 51/295 |
| 5,108,463 | 4/1992 | Buchanan | 51/295 |
| 5,137,542 | 8/1992 | Buchanan et al. | 51/295 |
| 5,152,917 | 10/1992 | Pieper et al. | 51/295 |
| 5,203,884 | 4/1993 | Buchanan et al. | 51/295 |
| 5,254,194 | 10/1993 | Ott et al. | 156/176 |
| 5,314,513 | 5/1994 | Miller et al. | 51/295 |
| 5,328,716 | 7/1994 | Buchanan | 427/121 |
| 5,368,618 | 11/1994 | Masmar et al. | 51/295 |
| 5,417,726 | 5/1995 | Stout et al. | 51/293 |
| 5,435,816 | 7/1995 | Spurgeon et al. | 51/295 |
| 5,436,063 | 7/1995 | Follett et al. | 428/224 |
| 5,549,961 | 8/1996 | Haas et al. | 428/143 |
| 5,560,753 | 10/1996 | Schnabel et al. | 51/295 |
| 5,565,011 | 10/1996 | Follett et al. | 51/297 |
| 5,573,619 | 11/1996 | Benedict et al. | 156/137 |
| 5,578,097 | 11/1996 | Gaeta et al. | 51/295 |
| 5,595,578 | 1/1997 | Stubbs et al. | 51/295 |

FOREIGN PATENT DOCUMENTS

| | | |
|---|---|---|
| 0 071 723 A2 | 2/1983 | European Pat. Off. . |
| 0 638 392 A1 | 2/1995 | European Pat. Off. . |
| WO 93/12911 | 7/1993 | WIPO . |
| WO 95/19242 | 7/1995 | WIPO . |
| WO 97/14535 | 4/1997 | WIPO . |

OTHER PUBLICATIONS

*Encyclopedia of Polymer Science & Engineering*, vol. 17; John Wiley & Sons: New York; pp. 784–795 (1989).

*Encyclopedia of Polymer Science & Technology*, vol. 14; John Wiley & Sons: New York; p. 768 (1971).

*Kirk–Othmer Encyclopedia of Chemical Technology*, vol. 24 (3rd Edition); John Wiley & Sons: New York; pp. 466–481 (1984).

*Kirk–Othmer Encyclopedia of Chemical Technology*, vol. 25 (4th Edition); John Wiley & Sons: New York; pp. 614–626 (1998).

*Kirk–Othmer Encyclopedia of Chemical Technology*, vol. 22 (2nd Edition); John Wiley & Sons: New York; pp. 156–173 (1970).

Knop et al., in *Chemistry and Application of Phenolic Resins*; Springer–Verlag: Berlin; pp. 108–113 (1979).

J.S. Michelman et al., "Wax emulsions in aqueous polymeric coatings: contributions and mechanisms", *Tappi Journal,* 72, 159–163 (Apr. 1989).

"BYK–370" Data Sheet, Brochure of BYK–chemie USA, Wallingford, CT, 2 pgs, Jul. 1991.

"Waxes" in *Chemical Technology*, 5, pp. 160–162, 1972 no month.

*Primary Examiner*—Deborah Jones
*Attorney, Agent, or Firm*—Paul W. Busse

[57] ABSTRACT

An abrasive article is provided that includes a bond system formed from a binder precursor and about 15% by weight or less of a wax-containing modifier. An abrasive article that includes the bond system exhibits an increase of workpiece surface abraded in a Woodsanding Normal Force Test as compared to an abrasive article including a bond system formed from a composition containing substantially no wax-containing modifier.

44 Claims, 2 Drawing Sheets

ABRASIVE ARTICLES INCLUDING AN ANTILOADING COMPOSITION

FIELD OF THE INVENTION

The invention relates to abrasive articles including an antiloading composition. In particular, abrasive articles in accordance with the invention are useful in abrading the surface of wood and wood-like materials, including particle board, press board, and the like. Also included are methods for making and methods of using abrasive articles.

BACKGROUND OF THE INVENTION

In general, abrasive products are known to have abrasive particles adherently bonded to a sheet-like backing. It is generally known to stratify the abrasive particles and binders, such as in coated abrasive articles, in such a way as to basically segregate the abrasive particles between an underlying binder and an overlaying binder.

More typically, abrasive products have a backing substrate, abrasive particles, and a binder which operates to bond or hold the abrasive particles to the backing. For example, a typical coated abrasive product has a backing that is first coated with a binder, commonly referred to as a "make coat", and then the abrasive particles are applied to the make coat. The application of the abrasive particles to the make coat typically involves electrostatic deposition or a mechanical process which maximizes the probability that the individual abrasive particles are positioned with their major axis oriented perpendicular to the backing surface. As so applied, the abrasive particles optimally are at least partially embedded in the make coat that is then generally solidified or set (such as by a series of drying or curing ovens) to a state sufficient to retain the adhesion of abrasive particles to the backing.

Optionally, after precuring or setting the make coat, a second binder, commonly referred to as a "size coat", can be applied over the surface of the make coat and abrasive particles, and, upon setting, it further supports the particles and enhances the anchorage of the particles to the backing. Further, a "supersize" coat, which may contain grinding aids, anti-loading materials or other additives can be applied over the cured size coat. In any event, once the size coat and supersize coat, if used, has been cured, the resulting coated abrasive product can be converted into a variety of convenient forms such as sheets, rolls, belts, and discs.

Coated abrasives are used to abrade a variety of workpieces including metal, metal alloys, glass, wood, paint, plastics, etc. In abrading certain workpieces, for example, wood, paint, and plastics, the coated abrasive has a tendency to "load". "Load" or "loading" are terms used in the industry to describe the debris, or swarf, that is abraded away from the workpiece surface that subsequently becomes lodged between the abrasive particles of the abrasive article. Loading is generally undesirable because the debris lodged between abrasive particles inhibits the cutting ability of the abrasive article.

On solution to the loading problem is to apply a supersize coating over the size coating. For example, U.S. Pat. No. 2,768,886, describes a metal stearate supersize coating that may reduce the amount of loading. Metal stearate supersize coatings have been employed in coated abrasive articles that are designed to abrade paint and lacquer type coatings. However, metal stearate supersize coatings may not be effective in some abrading operations. For example, wood and wood-like materials (such as particle board and pressboard) are typically abraded with coated abrasive belts.

These coated abrasive belts typically operate at higher abrading speeds and pressures than coated abrasive discs or sheets. As a result, a metal stearate supersize is worn away from the coated abrasive belt in a relatively short period of time. The end result is that the metal stearate supersize may be effective at reducing loading in a coated abrasive belt but the supersize life is essentially so short so as to be ineffective.

Loading is a serious problem in the area of wood sanding. In many applications, coated abrasive articles tend to load with the sawdust that is abraded away from the wood or wood-like surface. This loading typically leads to burning of the sawdust at the interface between the surface of the abrasive article and the surface of the wood workpiece adjacent to the abrasive article. If sawdust burning does occur, this can lead to damage to the underlying wood workpiece. Additionally, loading reduces the effective work life of the coated abrasive article.

Thus, what is desired in the industry is a load resistant coating for abrasive articles that can be used under relatively high abrading pressures and relatively high abrading speeds.

SUMMARY OF THE INVENTION

Typically, an abrasive article in accordance with the invention includes a backing, a plurality of abrasive particles and at least one bond system, wherein the bond system bonds the plurality of abrasive particles to the backing. The at least one bond system is formed from a composition including a binder precursor and preferably about 15% by weight or less, more preferably about 0.1% by weight to about 5.0% by weight, most preferably about 0.5% by weight to about 3.0% by weight, of a wax-containing modifier. The wax-containing modifier may be in the form of a wax dispersion.

As used herein, "wax" refers to a material that is generally characterized as a thermoplastic. Physical properties of such a material include its ability to be polished, kneaded, cold worked, emulsified, dissolved and liquified, either through heat or solubilization with other materials, such as fats or solvents. At ambient temperature, it is typically solid, but will melt and flow at elevated temperatures, e.g., about 40° C. to about 120° C., without substantial decomposition. In a solid state, the material may be brittle, coarse or finely divided crystalline, translucent or opaque. In a liquid state, the material typically has a low melt viscosity, even near the melting point. Many of these materials are oleophilic, water insoluble, exhibit limited toxicity, and are generally free from objectionable odor and color.

Chemically, these materials are generally composed of a mixture of compounds, are typically not polymeric, and can include functional groups, such as an acid, an alcohol, an acetal, an amide, an ester, an aldehyde, a ketone, for example. These materials are typically considered hydrocarbons and can be aliphatic and aromatic. Such materials can also include molecular structures such as esters of fatty acids, monohydric alcohols, long chain hydrocarbons (both linear and branched) with carbon atom chain lenghts of about 20 to about 70 atoms per molecule. The presence of long carbon atom chains typically imparts water repellancy and hydrophobicity to these materials.

These materials typically fall into two classes: natural waxes and synthetic waxes. Natural waxes include materials having the characteristics described above and can be derived from insects (e.g., beeswax), animals (e.g., spermaceti), vegetables (e.g., camauba, candelilla, Japan, castor), and minerals, such as fossil (e.g., montan, ozokerite, ceresin) or petroleum (e.g., paraffin, microcrystalline, slack, scale). Synthetic waxes include materials having the characteristics described above and can be derived from polyolefins (e.g., polyethylene, polypropylene), polyol ether-esters (e.g., sorbitol), chlorinated naphthalenes (e.g., halowax), hydrocarbons, such as those derived from Fischer-Tropsch synthesis, chemically modified hydrocarbon waxes (e.g., oxidized microcrystalline wax), and substituted amides (e.g., N,N'-distearoylethylenediamine).

As used herein, "dispersion" means a stable system of finely divided particles distributed throughout a liquid, preferably an aqueous, medium and can be a macroemulsion or a microemulsion.

In one embodiment of the invention, the plurality of abrasive particles and the at least one bond system together form a plurality of precisely shaped composites on a first major surface of the backing.

In another embodiment of the present invention, the at least one bond system is a size coat bond system. Thus, an abrasive article in accordance with the invention includes a backing, a plurality of abrasive particles and a make coat bond system which bonds the plurality of abrasive particles to the backing. Preferably, the size coat bond system is present on at least a portion of the plurality of abrasive particles and forms at least a portion of a peripheral surface of the abrasive article.

The term "peripheral surface", as used herein, refers to a portion of the bond system that is present over and in between at least a portion of the plurality of abrasive particles and is capable of contacting and abrading the surface of the workpiece by an abrasive article.

In yet another embodiment of the present invention, an abrasive article includes a backing, a plurality of abrasive particles and a make coat bond system that bonds the plurality of abrasive particles to the backing. Also included is a size coat bond system that forms at least a portion of a peripheral surface of the abrasive article. Preferably, the size coat bond system is formed from a composition as described above.

A further embodiment of the present invention is a method for making an abrasive article. The method includes applying a first binder precursor to a substrate, at least partially imbedding a plurality of abrasive particles in the first binder precursor and at least partially curing the first binder precursor. The method also includes applying a composition formed by blending a second binder precursor and preferably about 15% by weight or less, more preferably about 0.1% by weight to about 5.0% by weight, most preferably about 0.5% by weight to about 3.0% by weight, of a wax-containing modifier over the at least partially cured first binder precursor and curing the second binder precursor.

Another embodiment of the present invention is a method of abrading the surface of a workpiece with an abrasive article. The method includes frictionally engaging a peripheral surface of an abrasive article with a surface of a workpiece and moving the abrasive article and the workpiece relative to each other such that the surface of the workpiece is abraded. Preferably, the abrasive article includes a backing, a plurality of abrasive particles and at least one bond system, wherein the bond system bonds the plurality of abrasive particles to the backing. The at least one bond system is formed from a composition including a binder precursor and preferably about 15% by weight or less, more preferably about 0.1% by weight to about 5.0% by weight, most preferably about 0.5% by weight to about 3.0% by weight, of a wax-containing modifier.

It was surprising that when such a minor amount of a wax-containing modifier was included in a bond system of an abrasive article, improved abrading performance was observed in a Woodsanding Normal Force Test when compared to an abrasive article including a bond system containing substantially no wax-containing modifier as described herein.

BRIEF DESCRIPTION OF THE SEVERAL VIEWS OF THE DRAWING

Other features, advantages, and further methods of practicing the invention will be better understood from the following description of figures and the preferred embodiments of the present invention.

DETAILED DESCRIPTION OF PREFERRED EMBODIMENTS

Abrasive Articles

Figure 1:
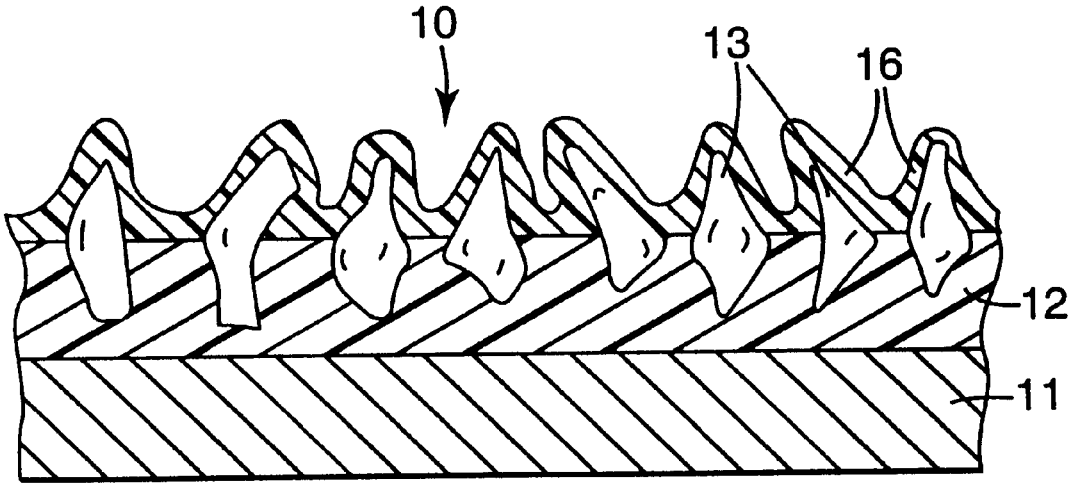
FIG. 1 is an enlarged cross-sectional view of one embodiment of an abrasive article of the present invention.

Abrasive articles in accordance with the invention typically comprise a plurality of abrasive particles and at least one bond system formed from a composition including a binder precursor, a wax-containing modifier, and an optional additive. Examples of abrasive articles include coated abrasive articles such as lapping or structured abrasive articles, and nonwoven abrasive articles.

Coated Abrasive Articles

Coated abrasive articles of the invention include a backing having a first major surface and a second major surface; a plurality of abrasive particles; a make coat bond system formed from a first binder precursor, wherein the make coat bond system bonds the plurality of abrasive particles to the first major surface of the backing; a size coat bond system formed from a composition comprising a second binder precursor, about 15% by weight or less of a wax-containing modifier and an optional additive. Preferably, the size coat bond system forms a peripheral coating of the abrasive article.

A backing for a coated abrasive article of the present invention can be any number of various materials conventionally used as backings in the manufacture of coated abrasives, such as paper, cloth, film, polymeric foam, vulcanized fiber, woven and nonwoven materials, and the like, or a combination of two or more of these materials or treated versions thereof. The backing may also be a laminate of paper/film, cloth/paper, film/cloth, and the like. The choice of backing material will depend on the intended application of the abrasive article. The strength of the backing should be sufficient to resist tearing or other damage in use, and the thickness and smoothness of the backing should allow achievement of the product thickness and smoothness desired for the intended application.

One preferred backing suitable for the use in the invention is a cloth backing. The cloth is composed of yarns in the warp direction, i.e., the machine direction and yarns in the fill direction, i.e., the cross direction. The cloth backing can be a woven backing, a stitchbonded backing, or a weft insertion backing. Examples of woven constructions include sateen weaves of 4 over one weave of the warp yarns over the fill yarns; twill weave of 3 over one weave; plain weave of one over one weave; and a drill weave of two over two weave. In a stitchbonded fabric or weft insertion backing, the warp and fill yams are not interwoven, but are oriented in two distinct directions from one another. The warp yarns are laid on top of the fill yarns and secured to another by a stitch yarn or by an adhesive.

Yarns in the cloth backing may be natural, synthetic or a combination thereof. Examples of natural yarns include cellulosic materials such as cotton, hemp, kapok, flax, sisal, jute, carbon, manilla and a combination thereof Examples of synthetic yarns include polyester yarns, polypropylene yarns, glass yarns, polyvinyl alcohol yarns, aramid yarns, polyimide yarns, rayon yarns, nylon yarns, polyethylene yarns and a combination thereof.

The backing in a coated abrasive article may have an optional saturant coat, a presize coat and/or a backsize coat. The purpose of these coats is to seal the backing and/or protect the yarn or fibers in the backing. If the backing is a cloth material, at least one of these coats may be required. The addition of the presize coat or backsize coat may additionally result in a "smoother" surface on either the front and/or the back side of the backing.

Additionally, an antistatic material may be included in any of these cloth treatment coats. The addition of an antistatic material can reduce the tendency of the coated abrasive article to accumulate static electricity when sanding wood or wood-like materials. Additional details concerning antistatic backings and backing coats (treatments) can be found in, for example, U.S. Pat. Nos. 5,108,463; 5,137,542; 5,328,716; and 5,560,753.

The backing may also be a fibrous reinforced thermoplastic, for example, as disclosed in U.S. Pat. No. 5,417,726, or an endless spliceless belt, for example, as disclosed in WO 93/12911. Likewise, the backing may be a polymeric substrate having hooking stems projecting therefrom, for example, as disclosed in WO 95/19242 (Chesley et al.). Similarly, the backing may be a loop fabric, for example, as described in U.S. Pat. No. 5,565,011.

Figure 2:
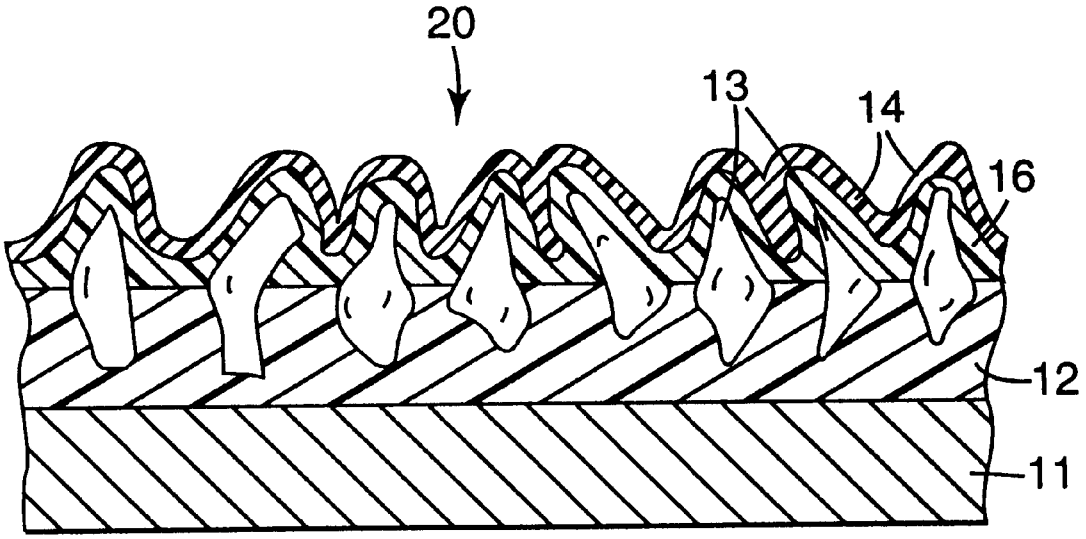
FIG. 2 is an enlarged cross-sectional view of another embodiment of an abrasive article of the present invention.

With reference to FIG. 1, a coated abrasive article 10 of the present invention may include a first bond system 12 (commonly referred to as a make coat) bonded to one side (a major surface) of the backing 11, a plurality of abrasive particles 13 bonded to the backing by the make coat 12, and a size coat bond system 16 formed from a composition including a binder precursor, a wax-containing modifier and an optional additive. Preferably, the size coat bond system 16 is formed on and in between the plurality of abrasive particles, thus forming a peripheral coating on the abrasive article. With reference to FIG. 2, a coated abrasive article 20 of the present invention may include a make coat bond system 12, a backing 11, a plurality of abrasive particles 13, and a size coat bond system 16, as described with respect to FIG. 1, and a supersize coat bond system 14 over at least a portion of the size coat bond system 16.

Coated abrasives of the present invention also include lapping abrasive articles and structured coated abrasive articles. A lapping coated abrasive article comprises a backing having an abrasive coating bonded to the backing. The abrasive coating comprises a plurality of abrasive particles distributed in a binder. In some instances, the binder bonds this abrasive coating to the backing. Alternatively, an additional material may be used to bond the abrasive coating to the backing, which may be selected, for example, from the binder precursors described herein and may be the same or different than the binder precursor used to form the abrasive coating. Generally, the particle size of the abrasive particles used in a lapping coated abrasive ranges, on average, from about 0.01 to less than about 200 micrometers, typically, 0.1 to 120 micrometers. The abrasive coating may have a smooth outer surface or a textured outer surface. The abrasive coating may also further comprise additives as discussed herein.

Figure 3:
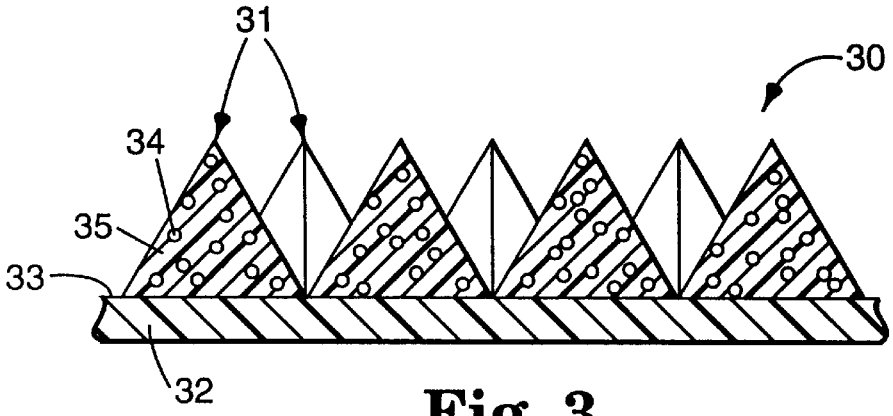
FIG. 3 is an enlarged cross-sectional view of an alternate embodiment of an abrasive article of the present invention.
Figure 4:
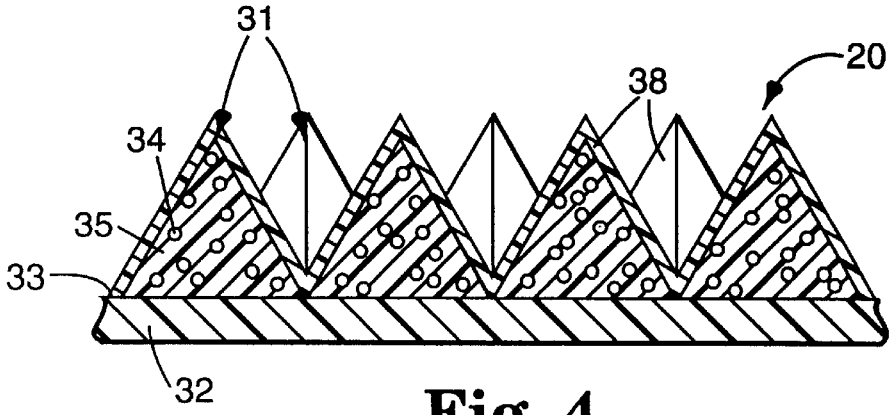
FIG. 4 is an enlarged cross-sectional view of a further embodiment of an abrasive article of the present invention.

With reference to FIG. 3, a structured abrasive article 30 comprises a backing 32 having a plurality of precisely shaped abrasive composites 31 bonded to a major surface 33 of the backing 32. In some instances, at least one bond system 35 bonds the abrasive composites to the backing, wherein the at least one bond system is formed from a composition including a binder precursor, a wax-containing modifier, and an optional additive. Alternatively, an additional material may be used to bond the abrasive composite to the backing, which may be selected, for example, from the binder precursors described herein and may be the same or different than the binder precursor used to form the abrasive composite. With reference to FIG. 4, a structured abrasive may comprise, in addition to a backing 32 having a major surface 33, and a plurality of abrasive composites 31 comprising a binder 35 and a plurality of abrasive particles 34, a peripheral coating 38 over at least a portion of the plurality of abrasive composites 31.

In some instances, it may be preferred to incorporate a pressure sensitive adhesive onto the back side of the coated abrasive such that the resulting coated abrasive can be secured to a back up pad. Representative examples of pressure sensitive adhesives suitable for this invention include latex crepe, rosin, acrylic polymers and copolymers e.g., polybutylacrylate, polyacrylate ester, vinyl ethers, e.g., polyvinyl n-butyl ether, alkyd adhesives, rubber adhesives, e.g., natural rubber, synthetic rubber, chlorinated rubber, and mixtures thereof A preferred pressure sensitive adhesive is an isooctylacrylate:acrylic acid copolymer. The coated abrasive can be in the form of a roll of abrasive discs, as described in U.S. Pat. No. 3,849,949.

Alternatively, the coated abrasive may contain a hook and loop type attachment system to secure the coated abrasive to the back up pad. The loop fabric may be on the back side of the coated abrasive with hooks on the back up pad. Alternatively, the hooks may be on the back side of the coated abrasive with the loops on the back up pad.

A hook and loop type attachment system is further described in U.S. Pat. Nos. 4,609,581 and 5,254,194 and International Publication No. WO 95/19242. Alternatively, the make coat precursor may be coated directly onto the loop fabric, for example, as disclosed in U.S. Pat. No. 5,565,011 (Follett et al.). In this arrangement, the loop fabric can releasably engage with hooking stems present on a support pad. The make coat precursor may also be coated directly on a hooking stem substrate, which generally comprises a substrate having a front and back surface. The make coat precursor can then be applied to the front surface of the substrate, the hooking stems protruding from the back surface. In this arrangement, the hooking stems can releasably engage with a loop fabric present on a support pad.

The coated abrasive may be converted into a variety of different shapes and forms such as belts, discs, sheets, tapes, daisies and the like. The belts may contain a splice or a joint, alternatively the belts may be spliceless such as that taught in International Publication No. WO 93/12911. The belt width may range from about 0.5 cm to 250 cm, typically anywhere from about 1 cm to 150 cm. The belt length may range from about 5 cm to 1000 cm, typically 10 cm to 500 cm. The belt may have straight or scalloped edges. The discs may contain a center hole or have no center hole. The discs may have the following shapes: round, oval, octagon, pentagon, hexagon or the like; all of these converted forms are well known in the art. The discs may also contain dust holes, typically for use with a tool containing a vacuum source. The diameter of the disc may range from about 0.1 cm to 1500 cm, typically from 1 cm to 100 cm. The sheets may be square, triangular, or rectangular. The width ranges from about 1 cm to 100 cm, typically 10 cm to 50 cm. The length ranges from about 1 cm to 1000 cm, typically 10 cm to 100 cm.

It is also feasible to adhere the abrasive particles to both a major or working surface and the opposite surface of a backing. The abrasive particles can be the same or different from one another. In this aspect, the abrasive article is essentially two sided; one side can contain a plurality of abrasive particles which are different from a plurality of abrasive particles on the other side. Alternatively, one side can contain a plurality of abrasive particles having a different particle size than those on the other side. In some instances, this two sided abrasive article can be used in a manner in which both sides of the abrasive article abrade at the same time. For example, in a small area such as a corner, one side of the abrasive article can abrade the top workpiece surface, while the other side can abrade the bottom workpiece surface.

Nonwoven Abrasive Articles

Figure 5:
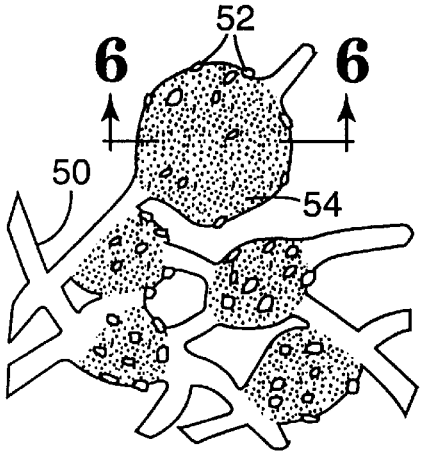
FIG. 5 is an enlarged cross-sectional view of yet another embodiment of an abrasive article of the present invention.
Figure 6A:
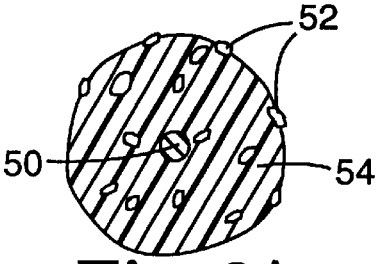
FIG. 6A and 6B illustrate a view taken along line 6—6 of FIG. 5 of one embodiment of an abrasive article of the present invention.
Figure 6B:
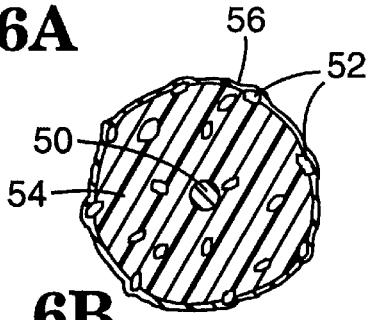

Nonwoven abrasive articles are also within the scope of the invention and include an open, lofty fibrous substrate having a binder which binds fibers at points where they contact. Optionally, abrasive particles or nonabrasive particles (such as fillers) may be adhered to the fibers by the binder if the manufacturer desires. For example, with reference to FIG. 5, a nonwoven abrasive comprises an open, lofty, fibrous substrate comprising fibers 50 and a bond system 54 which binds a plurality of abrasive particles 52 to the fibers. FIG. 6A illustrates a view, along line 6—6 in FIG. 5, of a bond system 54 and abrasive particles 52. In the embodiment represented by FIG. 6A, the bond system 54 is formed from a composition including a binder precursor, a wax-containing modifier, and an optional additive. FIG. 6B illustrates another embodiment of the present invention wherein a peripheral coating 56 is coated over at least a portion of the bond system 54 and abrasive particles 52.

Nonwoven abrasives are described generally in U.S. Pat. Nos. 2,958,593 and 4,991,362. In the present invention, an antiloading component is present in a part of the abrasive article which will ultimately contact a workpiece during abrading, for example, in a peripheral portion of the nonwoven abrasive article, for example, in a binder or in a peripheral coating over at least a portion of the binder.

Binders

Binders suitable for an abrasive article of the present invention are formed from a binder precursor. However, it is within the scope of the present invention to use a water-soluble binder precursor or water-dispersible binder precursor. A binder in accordance with the present invention comprises a cured or solidified binder precursor and serves to adhere a plurality of abrasive particles to a substrate (i.e., a backing for a coated abrasive or a nonwoven for a nonwoven abrasive). The binder included in the make coat, size coat and the supersize coat may be formed from the same binder precursor or each may be formed from a different binder precursor.

The term "binder precursor" as used herein refers to an uncured or a flowable material. The binder precursor is preferably a thermosetting resin. More preferably, the binder precursor is selected from the group of a phenolic resin, an aminoplast resin having pendant $\alpha,\beta$-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

Phenolic resins are commonly used as an abrasive article binder precursor because of their thermal properties, availability, cost and ease of handling. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one.

Typical resole phenolic resins contain a base catalyst. The presence of a basic catalyst speeds up the reaction or polymerization rate of the phenolic resin. The pH of the phenolic resin is preferably from about 7 to about 12, more preferably from about 7 to about 10 and most preferably from about 7 to about 9. Examples of suitable basic catalysts include sodium hydroxide, potassium hydroxide, calcium hydroxide, magnesium hydroxide, barium hydroxide and a combination thereof. Typical catalysts for the reaction of formaldehyde with phenol are chosen from group I and II metal salts, generally because of their high reactivity and low cost. Amines are also used to catalyze the phenol/aldehyde reaction. The preferred basic catalyst is sodium hydroxide. The amount of basic catalyst is preferably about 5% by weight or less, more preferably about 2% by weight or less, even more preferably about 1% by weight or less and most preferably from about 0.5% by weight to about 0.9% by weight of the phenolic resin.

Resole phenolic resins usually are made from phenol and formaldehyde. A portion of the phenol can be substituted with other phenols such as resorcinol, m-cresol, 3,5-xylenol, t-butyl phenol and p-phenylphenol. Likewise a portion of the formaldehyde can be substituted with other aldehyde groups such as acetaldehyde, chloral, butylaldehyde, furfural or acrolein. The general term "phenolic" includes phenol-formaldehyde resins as well as resins comprising other phenol-derived compounds and aldehydes. Phenol and formaldehyde are the most preferred constituents in the phenolic resin due to their high reactivity, limited number of side chain reactions and low cost. Resole phenolic and urea-aldehyde resins are preferably about 30% to about 95% solids, more preferably about 60% to about 80% solids, have a viscosity ranging from about 750 cps to about 1500 cps (Brookfield viscometer, number 2 spindle, 60 rpm, 25° C.) before addition of any diluent, and have molecular weight (number average) of about 200 or greater, preferably varying from about 200 to about 700.

The phenolic resin preferably includes about 70% to about 85% solids, and more preferably about 72% to about 82% solids. If the percent solids is very low, then more energy is required to remove the solvent. If the percent solids is very high, then the viscosity of the resulting phenolic resin is too high which leads to processing problems. The remainder of the phenolic resin can be an organic solvent. More preferably, the remainder of the phenolic resin is water with substantially no organic solvent due to environmental concerns with both the manufacturing of phenolic resins and abrasive articles.

Examples of commercially available phenolic resins include those known under the trade designations "Varcum"

and "Durez" from Occidental Chemical Corp., Tonawanda, N.Y.; "Arofene" and "Arotap" from Ashland Chemical Company, Columbus, Ohio; "Resinox" from Monsanto, St. Louis, Mo.; and "Bakelite" from Union Carbide, Danbury, Conn.

It is also within the scope of the present invention to modify the physical properties of a phenolic resin. For example, a plasticizer, latex resin, or reactive diluent may be added to a phenolic resin to modify flexibility and/or hardness of the cured phenolic binder.

A suitable aminoplast resin for use in a binder precursor is one having at least one pendant α,β-unsaturated carbonyl groups per molecule. These unsaturated carbonyl groups can be acrylate, methacrylate or acrylamide type groups. Examples of such materials include N-hydroxymethylacrylamide, N,N'-oxydimethylenebisacrylamide, ortho and para acrylamidomethylated phenol, acrylamidomethylated phenolic novolac and combinations thereof.

Suitable polyurethanes for a binder precursor may be prepared by reacting near stoichiometric amounts of polyisocyanates with polyfunctional polyols. The more common types of polyisocyanates are toluene diisocyanate (TDI) and 4,4'-diisocyanatodiphenylmethane (MDI) which are available under the trade designations "Isonate" from Upjohn Polymer Chemicals, Kalamazoo, Mich. and "Mondui" from Miles, Inc., Pittsburgh, Pa. Common polyols for flexible polyurethanes are polyethers such as polyethylene glycols, which are available under the trade designations "Carbowax" from Union Carbide, Danbury, Conn.; "Voranol"from Dow Chemical Co., Midland, Mich.; and "Pluracol E" from BASF Corp., Mount Olive, N.J.; polypropylene glycols, which are available under the trade designations "Pluracol P" from BASF Corp. and "Voranol" from Dow Chemical Co., Midland, Mich.; and polytetramethylene oxides, which are available under the trade designations "Polymeg" from QO Chemical Inc., Lafayette, Ind.; "Poly THF" from BASF Corp., Mount Olive, N.J.; and "TERATHANE" from DuPont, Wilmington, Del. Hydroxyl functional polyesters are available under the trade designations "Multranol" and "Desmophene" from Miles, Inc., Pittsburgh, Pa.

Epoxy resins utilized in a binder precursor have an oxirane ring and are polymerized by ring opening. Such epoxide resins include monomeric epoxy resins and polymeric epoxy resins. These resins can vary greatly in the nature of their backbones and substituent groups. Examples of epoxy resins include 2,2-bis[4-(2,3-epoxypropoxyphenol)propane (diglycidyl ether of bisphenol A)] and commercially available materials under the trade designations, "Epon 828", "Epon 1004", and "Epon 1001F", available from Shell Chemical Co., Houston, Tex.; "DER-331", "DER-332", and "DER-334", all available from Dow Chemical Co., Midland, Mich. Other suitable epoxy resins include glycidyl ethers of phenol formaldehyde novolac (e.g., "DEN-431" and "DEN-438" available from Dow Chemical Co., Midland, Mich.). Other epoxy resins include those described in U.S. Pat. No. 4,751,138.

Urea-aldehyde resins employed in binder precursor compositions comprise urea or any urea derivative and any aldehyde which are capable of being coatable, have the capability of reacting together at an accelerated rate in the presence of a catalyst, preferably a cocatalyst, and which afford an abrasive article with abrading performance acceptable for the intended use. The resins comprise the reaction product of an aldehyde and a "urea".

Acrylate resins that can be included in a binder precursor include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Representative examples of acrylate monomers include methyl methacrylate, ethyl methacrylate, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate, as well as these unsaturated monomers, for example, styrene, divinylbenzene, vinyl toluene.

Acrylated isocyanurates useful in a binder precursor are isocyanurate derivatives having at least one pendant acrylate group, which are further described in U.S. Pat. No. 4,652,274.

Useful acrylated urethanes in a binder precursor are diacrylate esters of hydroxy terminated isocyanate extended polyesters or polyethers. Examples of commercially available acrylated urethanes include those available under the trade designations, "UVITHANE 782", Morton International, Inc., Cincinnati, Ohio; "Ebecryl6600", "Ebecryl 8400", and "Ebecryl 8805", from UCB Radcure, Inc., Atlanta, Ga.

Acrylated epoxies suitable for use in a binder precursor are monoacrylate and diacrylate esters of epoxy resins, such as the diacrylate esters of bisphenol A epoxy resin. Examples of commercially available acrylated epoxies include "Ebecryl 3500", "Ebecryl 3600", and "Ebecryl 3700", available from UCB Radcure, Inc., Atlanta, Ga.

Useful bismaleimide resins are further described in U.S. Pat. No. 5,314,513.

In addition to thermosetting resins, a hot melt resin may also be included in a binder precursor. For example, a binder precursor system may comprise a hot melt pressure sensitive adhesive which can be energy cured to provide a binder. In this instance, because the binder precursor is a hot melt composition, it is particularly useful with porous cloth, textile or fabric backings. Since this binder precursor does not penetrate the interstices of the porous backing, the natural flexibility and pliability of the backing is preserved. Exemplary hot melt resins are described in U.S. Pat. No. 5,436,063.

The hot melt binder precursor system may comprise an epoxy-containing material, a polyester component, and an effective amount of an initiator for energy curing the binder. More particularly, the binder precursor can comprise from about 2 to 95 parts of the epoxy-containing material and, correspondingly, from about 98 to 5 parts of the polyester component, as well as the initiator. An optional hydroxyl-containing material having a hydroxyl functionality greater than 1 may also be included.

Bond System

A bond system of the invention is preferably formed from a binder precursor, a wax-containing modifier, and an optional additive. Preferably, the binder precursor is selected from the group of a phenolic resin, an aminoplast resin, a polyurethane, an epoxy resin, an urea-aldehyde resin, an acrylate resin, an acrylated isocyanurate, an acrylated urethane, an acrylated epoxy, and a mixture thereof, as described above. More preferably, the binder precursor comprises a phenolic resin.

In formulating the bond system in an abrasive article according to the present invention, the coating characteristics of the bond system during manufacturing of an abrasive article must be balanced with the performance characteristics of the abrasive article including the bond system. For example, in manufacturing an abrasive article where a bond system is formed from a composition including a phenolic resin binder precursor and a wax-containing modifier, it will be appreciated that the phenolic resin is water based and polar while the wax-containing modifier is nonpolar. In order to produce a uniform coating of the bond system, the phenolic resin and the wax-containing modifier should be compatible so that a stable emulsion is produced when these components are mixed.

However, it was found that when too little wax-containing modifier is present (typically less than about 0.1% by weight), improved abrading performance is not observed. On the other hand, it is expected that when more than about 15% by weight of the wax-containing modifier is present, the bond system softens during the abrading process such that the performance is unpredictable. Accordingly, the wax-containing modifier is preferably present in an amount of about 15.0% by weight or less, more preferably about 0.1% by weight to about 5% by weight and most preferably about 0.5% by weight to about 3.0% by weight based on the weight of the resin plus wax-containing modifier. It was surprising that when such a small amount of a wax-containing modifier was included in a bond system of an abrasive article, improved abrading performance was observed.

A suitable wax-containing modifier preferably comprises a wax selected from the group of a paraffin wax, a microcrystalline wax, a castor wax, a beeswax, a carnauba wax, a Fischer-Tropsch wax, a polyethylene wax, an ouricuri wax, a ceresin wax, a polyolefin wax, an amide wax, and a mixture thereof More preferably, the wax-containing modifier comprises a wax selected from the group of a paraffin wax, a microcrystalline wax, a castor wax, a polyethylene wax, and a mixture thereof The wax-containing modifier may be an aqueous wax dispersion or emulsion of solids. A dispersion may also contain a mixture of waxes, as described above. For example, a wax dispersion preferably contains about 60% solids or less, more preferably about 55% solids to about 40% solids.

Suitable wax dispersions are commercially available, such as "Petrolite 75", an aqueous dispersion of microcrystalline and paraffin waxes at about 40% solids, available from Petrolite Corp., Tulsa, Okla.; "Mobilcer RV," paraffin wax at about 50% solids, available from Mobil Oil Corp., Fairfax, Va.; "DC Wax Emulsion BW-058", an aqueous dispersion of a paraffin based wax at 57% solids, available from Dominion Chemical Co., Petersburg, Va.

Abrasive Particles

Abrasive particles useful in the invention can be of any conventional grade utilized in the formation of abrasive articles. Suitable abrasive particles can be formed of, for example, flint, garnet, ceria, aluminum oxide (including fused and heat-treated aluminum oxide), alumina zirconia including fused alumina zirconia as disclosed, for example, in U.S. Pat. Nos. 3,781,172; 3,891,408; and 3,893,826, and commercially available from the Norton Company of Worcester, Mass., under the trade designation "NorZon", diamond, silicon carbide (including refractory coated silicon carbide as disclosed, for example, in U.S. Pat. No. 4,505,720, silicone nitride, alpha alumina-based ceramic material, as disclosed, for example, in U.S. Pat. Nos. 4,518,397; 4,574,003; 4,744,802; 4,770,671; 4,881,951; and 5,011,508, titanium diboride, boron carbide, tungsten carbide, titanium carbide, iron oxide, cubic boron nitride, and mixtures thereof.

Abrasive particles may be individual abrasive grains or agglomerates of individual abrasive grains. Abrasive particles may have a particle size ranging from about 0.01 micrometers to about 1500 micrometers, preferably from about 1 micrometer to about 1000 micrometers. The frequency (concentration) of the abrasive particles on the backing depends on the desired application and is within the purview of the skilled artisan. The abrasive particles can be oriented or can be applied without orientation, depending upon the requirements of the particular abrasive product.

The abrasive particles may be applied as an open or closed coat. A closed coat is one in which the abrasive particles completely cover the major surface of the backing. In an open coat, the abrasive particles cover about 20% to about 90% of the major surface of the backing, typically about 40% to about 70%. For constructions in accordance with the present invention, open coating of abrasive particles is typically utilized.

An abrasive article of the present invention may contain a blend of abrasive grains and diluent particles. Diluent particles can be selected from the group consisting of: (1) an inorganic particle (non-abrasive inorganic particle), (2) an organic particle, (3) an abrasive agglomerate containing abrasive grains, (4) a composite diluent particle containing a mixture of inorganic particles and a binder, (5) a composite diluent particle containing a mixture of organic particles and a binder.

Optional Additives

Optional additives, such as, for example, fillers (including grinding aids), fibers, antistatic agents, lubricants, wetting agents, surfactants, pigments, dyes, coupling agents, plasticizers, release agents, suspending agents, and curing agents including free radical initiators and photoinitiators, may be included in abrasive articles of the present invention. The optional additives may be included in a binder precursor or in a bond system. These optional additives may further require that additional components be included in the binder precursor composition to aid in curing; for example, a photoinitiator may be required when acrylates are used. The amounts of these materials can be selected to provide the properties desired.

For example, a bond system including a binder precursor and a wax-containing modifier can further include a wetting agent, preferably, an anionic surfactant, i.e., a surfactant capable of producing a negatively charged surface active ion. Preferable anionic surfactants are commercially available, such as "Interwet 33", a glycol ester of fatty acids, available from Interstab Chemicals, New Brunswick, N.J.; and "Emulon A", an ethoxylated oleic acid, available from BASF Corp., Mount Olive, N.J., to name a few. Preferably, the anionic surfactant is in an amount sufficient to allow for uniform wetting of the backing, the make coat bond system and the abrasive particles, more preferably about 0.5% by weight or less, even more preferably about 0.3% by weight or less, and most preferably about 0.2% by weight. The anionic surfactant may be premixed with the binder precursor, such as a phenolic resin, followed by adding the wax-containing modifier, such as those commercially available from Tirarco Chemical Co. under the trade designations "Octowax 695" (an aqueous, anionic emulsion of paraffin wax at 50% solids), "Octowax 437" (an aqueous, anionic emulsion of paraffin and microcrystallline waxes at 53% solids), and "Octowax 321" (an aqueous, anionic emulsion of paraffin wax at 50% solids).

Examples of useful fillers for this invention include: metal carbonates, such as calcium carbonate (chalk, calcite, marl, travertine, marble and limestone), calcium magnesium carbonate, sodium carbonate, magnesium carbonate; silica (such as quartz, glass beads, glass bubbles and glass fibers); silicates, such as talc, clays, montmorillonite, feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; carbon black; metal oxides, such as calcium oxide, aluminum oxide, titanium dioxide; and metal sulfites, such as calcium sulfite. Examples of useful fillers also include silicon compounds, such as silica flour, e.g., powdered silica having a particle size of from about 4 to 10 mm (available from Akzo Chemie America, Chicago, Ill.), and calcium salts, such as calcium carbonate and calcium metasilicate (available under the trade designations, "Wollastokup" and "Wollastonite" from Nyco Company, Willsboro, N.Y.).

Examples of antistatic agents include graphite, carbon black, vanadium oxide, humectants, and the like. These antistatic agents are disclosed in U.S. Pat. Nos. 5,061,294; 5,137,542; and 5,203,884.

A coupling agent can provide an association bridge between the binder and the filler particles. Additionally the coupling agent can provide an association bridge between the binder and the abrasive particles. Examples of coupling agents include silanes, titanates, and zircoaluminates. There are various means to incorporate the coupling agent. For example, the coupling agent may be added directly to the binder precursor. The binder may contain anywhere from about 0.01 to 3% by weight coupling agent. Alternatively, the coupling agent may be applied to the surface of the filler particles or the coupling agent may be applied to the surface of the abrasive particles prior to being incorporated into the abrasive article. The abrasive particles may contain anywhere from about 0.01 to 3% by weight coupling agent.

Curing agents such as an initiator may be used, for example, when the energy source used to cure or set a binder precursor is heat, ultraviolet light, or visible light in order to generate free radicals. Examples of curing agents such as photoinitiators that generate free radicals upon exposure to ultraviolet light or heat include organic peroxides, azo compounds, quinones, nitroso compounds, acyl halides, hydrazones, mercapto compounds, pyrylium compounds, imidazoles, i,chlorotriazines, benzoin, benzoin alkyl ethers, diketones, phenones, and mixtures thereof.

Methods of Making Abrasive Articles

Coated Abrasive Articles

Coated abrasive articles of the present invention may be prepared using coatable binder precursors. A binder precursor can be used in coated abrasive article embodiments where only a single coating binder is employed, i.e., where a single coating takes the place of a make coat/size coat combination, for example, in a lapping coated abrasive.

Reference to preparing a coated abrasive article having a make and size coat is set forth. After the backing has been properly treated with a treatment coating, if desired, a make coat binder precursor can be applied. After the make coat binder precursor is applied, abrasive particles can be applied into and over the make coat binder precursor. The abrasive particles can be drop coated or electrostatically coated. Next, the make coat binder precursor, now bearing abrasive particles, can be exposed to a heat source which generally solidifies or sets the binder sufficiently to hold the abrasive particles to the backing. In some instances, the make coat binder precursor can be partially cured before the abrasive particles are embedded into the make coat as described in U.S. Pat. No. 5,368,618. Then, a size coat binder precursor can be applied. The make coat binder precursor and/or size coat binder precursor can be applied by any suitable method including roll coating, spraying, die coating, curtain coating, and the like. The temperature of the make coat binder precursor and/or size coat binder precursor can be room temperature or higher, preferably from 30° C. to 60° C., more preferably from 30° C. and 50° C. The size coat binder precursor/abrasive particle/(at least partially cured) make coat combination can be exposed to a heat source, for example, via a festoon or drum cure, or, alternatively, a radiation source. The size coat binder precursor may contain, for example, acrylates and a photoinitiator. In this instance, the binder precursor may be exposed to ultraviolet irradiation immediately after the size coat binder precursor is applied and prior to exposure to the heat source described above. Exposure to a heat source will substantially cure or set the make and size coat binder precursor used in the coated abrasive constructions. Standard thermal cure conditions can be used to effect curing, for example, temperatures between 50° C. to 150° C., typically 75° C. to 120° C., preferably 80° C. to 115° C. An optional supersize coat binder precursor may be applied over the size coat by any conventional technique and cured by the standard thermal cure conditions described herein.

It is also feasible to use a hot melt binder precursor, for example as disclosed in U.S. Pat. Nos. 5,565,01 and 5,436,063.

A size coat may be subsequently applied over the abrasive particles and the make coat as a flowable liquid by a variety of techniques such as roll coating, spray coating or curtain coating and can be subsequently cured by drying, heating, or with electron beam or ultraviolet light radiation. The particular curing approach may vary depending on the chemistry of the size coat.

A structured coated abrasive may be prepared as described in assignee's U.S. Pat. Nos. 5,152,917 and 5,435,816. One method involves 1) introducing the abrasive slurry onto a production tool, wherein the production tool has a specified pattern; 2) introducing a backing to the outer surface of the production tool such that the slurry wets one major surface of the backing to form an intermediate article; 3) at least partially curing or gelling the resinous adhesive before the intermediate article departs from the outer surface of the production tool to form a structured coated abrasive article; and 4) removing the coated abrasive article from the production tool. Another method involves 1) introducing the abrasive slurry onto the backing such that the slurry wets the front side of the backing forming an intermediate article; 2) introducing the intermediate article to a production tool having a specified pattern; 3) at least partially curing or gelling the resinous adhesive before the intermediate article departs from the outer surface of the production tool to form a structured coated abrasive article; and 4) removing the structured coated abrasive article from the production tool. If the production tool is made from a transparent material, e.g., a polypropylene or polyethylene thermoplastic, then either visible or ultraviolet light can be transmitted through the production tool and into the abrasive slurry to cure the resinous adhesive. Alternatively, if the coated abrasive backing is transparent to visible or ultraviolet light, visible or ultraviolet light can be transmitted through the coated abrasive backing. In these two methods, the resulting solidified abrasive slurry or abrasive composite will have the inverse pattern of the production tool. By at least partially curing or solidifying on the production tool, the abrasive composite has a precise and predetermined pattern. The resinous adhesive can be further solidified or cured off the production tool.

A lapping coated abrasive can be prepared by coating an abrasive slurry onto at least one side of a backing. A preferred backing is a polymeric film, such as polyester film having a primer coating on at least one surface of the film. Coating can be accomplished by spraying, rotogravure coating, roll coating, dip coating or knife coating. After the coating process, the slurry can be solidified, to form an abrasive coating, by exposure to an energy source including thermal and radiation energy (e.g., electron beam, ultraviolet light and visible light).

In any coated abrasive article of the present invention, an antiloading component can be incorporated in a binder precursor which forms a peripheral portion of the abrasive article. For example, the antiloading component may be incorporated in a make coat precursor, a size coat binder precursor, or an abrasive slurry. The antiloading component can be combined with the binder precursor using any suitable method, including but not limited to a mill having a half horsepower motor, for example, commercially available from Charles Ross and Son Company, Hauppauge, N.Y., under the trade designation "Ross Mill Model ME 100L". Such mills are especially useful in incorporating pulverized solids and any material(s) difficult to mix into the binder precursor, but commonly normal mixing techniques are adequate. The antiloading component may be present in a peripheral composition, if present, for example, a supersize coat of a coated abrasive article also having a make, a plurality of abrasive particles, and a size coat construction. The antiloading component is, in all embodiments, present in a part of the coated abrasive article which will ultimately contact a workpiece during abrading.

Nonwoven Abrasive Articles

A nonwoven abrasive article may be prepared by combining a binder precursor with abrasive particles and optional additives to form a coatable, binder precursor slurry. The slurry can be coated, for example, by roll coating or spray coating, onto at least a portion of the fibers of a lofty, open fibrous web, and the resulting structure subjected to conditions sufficient to affect curing of the binder precursor, as described herein.

A general procedure for making lofty, open nonwoven abrasives includes those generally illustrated in U.S. Pat. No. 2,958,593, and those prepared according to the teachings of U.S. Pat. Nos. 4,991,362 and 5,025,596.

An antiloading component of the present invention can be included in the slurry prior to coating or in a peripheral composition applied to at least a portion of the cured slurry to form a peripheral coating. The antiloading component is, in all embodiments, present in a part of the nonwoven abrasive article which will ultimately contact a workpiece during abrading.

Methods of Using Abrasive Articles

Typically, a method according to the invention includes frictionally engaging a peripheral surface of at least one bond system of an abrasive article with a surface of a workpiece. A suitable abrasive article may be any one of those described above, in accordance with the invention. The method includes moving the abrasive article and the workpiece relative to each other such that the surface of the workpiece is reduced. Moving the abrasive article and the workpiece surface relative to each other may include oscillating the abrasive article at an abrading interface (i.e., the contact between the abrasive article and the workpiece surface). In some instances, this oscillation may result in a finer surface of the workpiece being abraded.

A workpiece can be any type of material such as wood (oak, pine, maple, elm, cherry, and the like), wood-like material (fiberboard, particle board, pressboard, and the like), metal (aluminum, cast iron, and the like), composites (such as reinforced plastics), painted surfaces, plastics (including reinforced plastics), stone, and a combination thereof. The workpiece may be flat or may have a shape or contour associated with it.

Depending upon the application, the force at an abrading interface can range from about 1 Newton (NT) to 10,000 NT, or more. Typically, the range is from about 10 NT to about 5,000 NT. Typical organic compounds include lubricants, oils, emulsified organic compounds, cutting fluids, soaps, and the like. These liquids may also contain other additives such as defoamers, degreasers, corrosion inhibitors, and the like.

An abrasive article of the invention can be used by hand or used in combination with a machine. The abrasive article may be converted into a belt (including a spliceless belt as described, for example, in U.S. Pat. No. 5,573,619), tape roll, disc, sheet, and the like. A belt typically traverses over at least one idler roll and a platen or contact wheel. The hardness of the platen or contact wheel is adjusted to obtain the desired rate of cut and workpiece surface finish. A tape roll is generally a continuous length of an abrasive article that is usually unwound over a support pad that forces the tape against the workpiece surface and then the tape is rewound. Abrasive tapes can be continuously fed through the abrading interface and can be indexed. An abrasive disc, which also includes a "daisy" configuration, is typically secured to a back-up pad by an attachment means, wherein the disc rotates during abrading.

EXAMPLES

The following non-limiting examples will further illustrate the invention. All parts, percentages, ratios, etc., in the examples are by weight unless otherwise indicated.

Woodsanding Normal Force Test

In order to determine antiloading properties in the context of sanding a wood or wood-like substrate, a Woodsanding Normal Force Test was conducted. Abrasive articles in the following examples were converted to 168 cm by 7.6 cm continuous belts and installed on an ELB reciprocating bed grinding machine available from ELB Grinders Corp., Mountainside, N.J., under the trade designation "ELB Type SPA 2030ND".

The effective cutting area of the abrasive belt was 7.6 cm by 168 cm. The workpiece abraded by these belts was particle board of these dimensions: 1.6 cm width by 38 cm length by 28 cm height. Abrading was conducted along the 1.6 cm by 38 cm edge. The particle board workpiece was mounted on a reciprocating table. The speed of the abrasive belt was 1,676 surface meters/minute. The table speed, at which the workpiece traversed, was 12.2 meters per minute. The downfeed increment of the abrasive belt varied from 0.25 to 2.0 mm/pass of the workpiece and many times the downfeed increment was increased after each 12.2 cm of particle board sanded until the belt failed by loading which precedes burning of the loaded sawdust. "Downfeed" typically means that as the wood workpiece surface is abraded away, the abrasive article is moved down (i.e., toward the workpiece surface) prior to each abrading pass, such that it contacts the wood surface exposed during the abrading process. The process used was conventional surface grinding wherein the workpiece was reciprocated beneath the rotating abrasive belt with incremental downfeeding between each pass. This grinding was carried out dry. However, particle board characteristics may vary due to the relative humidity, the season of the year and composition of the wood workpiece.

Normal force (Fn) is the penetrating force of the abrasive article into the workpiece, in this case, particle board. The normal force (Fn) was monitored near the end of sanding each 12.2 cm segment of particle board. Typically, as sanding proceeds, the normal force increases. In general, the lower the normal force, the better the belt is performing the sanding of the workpiece. Loading of saw dust leads to both higher normal forces and eventually burning of both the loaded sawdust and the workpiece. The end point for this test was either burning of sawdust on the abrasive article surface and/or reaching 445 Newtons (NT) of normal force (Fn), that is the force at which the machine is programmed to stop.

The total amount of particle board cut and the normal force (Fn) are reported for each abrasive example evaluated below. The total amount of particle board cut is shown as the amount cut in $cm^3$ divided by the abrasive article path in $cm^2$. The normal force (Fn) is shown as Newtons (NT) at 24 cm/0.25 mm/pass of the abrasive article. In general, the lower the Fn, the more effectively the abrasive article abrades the workpiece. In general, loading of the abrasive article can contribute to higher normal forces. If loading does occur, there is also a tendency for decreased abrading performance in the abrasive article, which is reflected in the total amount cut.

Examples 1–11 and Comparative Examples A–D

Examples 1–11 and Comparative examples A–D were all coated abrasives having a backing of a Y weight woven cotton cloth available from Milliken & Co., Spartanburg, SC, weighing 523 $g/m^2$, which was pretreated to prepare the backing for receiving a make coat. A backsize coating containing conductive carbon black (an antistatic coat) in a phenolic binder was applied on the woven cotton cloth and dried and cured prior to making the abrasive articles to be tested.

For Examples 1–11 and Comparative Examples A–D, a coatable mixture for producing a make coat bond system for the backing was prepared by mixing 69 parts of 76% solids phenolic resin (48 parts phenolic resin), 52 parts non-agglomerated calcium carbonate filler (dry weight basis), and a solution of 90 parts water/10 parts propylene glycol monomethyl ether to form a make coating which was 84% solids, with a wet coating weight of about 70 $g/m^2$. The make coating was applied in each case via die coating. Next, grade P100 (ANSI standard B74.18 average particles size of 150 micrometers) fused aluminum oxide abrasive particles were electrostatically coated onto the uncured make coating with a weight of about 200 $g/m^2$. Then, the resulting constructions received a precure of 15 minutes at 65° C., followed by 75 minutes at 88° C.

Comparative examples A–D contained a coatable mixture of a 76% solids phenolic resin. This mixture was applied over the abrasive particles/make coat construction from above via two-roll coater. The wet size coating weight in each case was about 146 $g/m^2$. These abrasive articles then received a thermal cure of 30 minutes at 88° C. followed by 12 hours at 100° C. After this thermal cure, the coated abrasives were single flexed (i.e., passed over a roller at an angle of 90° to allow a controlled cracking of the make and size coatings), then converted into 7.6 cm by 168 cm coated abrasive belts.

Although Comparative examples A–D were formulated similarly, one comparative example was manufactured and tested with each group of examples in accordance with the invention. This was done so that the comparative examples were exposed to substantially the same conditions as the examples during the manufacturing and testing of the abrasive articles because environmental factors, such as temperature and humidity, affect the performance of the abrasive articles as does lot to lot variations of the wood-containing workpieces utilized in the Normal Force Test procedure.

Examples 1–3 and Comparative Example A

A modified size coat bond system utilized the abrasive articles of Examples 1–3. Table 1 shows the materials used in the modified size coat bond systems in accordance with the invention for Examples 1–3. In Examples 1–3, the mixture was applied over the abrasive particles/make coat construction from above via two-roll coater. The wet size coating weight in each case was about 146 $g/m^2$. These abrasive articles then received a thermal cure of 30 minutes at 88° C. followed by 12 hours at 100° C. The make coat, mineral (i.e., abrasive particles), and size coat bond system weights are listed in Table 2 for the abrasive articles of Examples 1–3.

Examples 1–3 were compared with Comparative Example A using the Woodsanding Normal Force Test, described above. The results are shown in Table 3. Particle board test conditions in Table 3 utilized progressive sequences that evaluated the antiloading durability of the abrasive article surface.

The downfeed sequences in Table 3 were 0.25 mm/Pass for 23.4 cm followed by 0.45 mm/Pass until burning. Downfeed sequences were continued until either the belt failed by burning and/or the normal force (Fn) exceeded 445 Newtons (NT) during sanding on the narrow edge of the particle board.

TABLE 1

SIZE COAT FORMULATIONS FOR EXAMPLES 1–3

| Components (weight in grams) | Ex. 1 | Ex. 2 | Ex. 3 |
|---|---|---|---|
| RPl (a resole phenolic resin prepared by reacting a molar excess of formaldehyde with phenol catalyzed with caustic resulting in 75% solids) | 100 | 100 | 100 |
| 3 micron calcium carbonate filler available from ECC International, Sylacauga, AL under the trade designation "MICROWHITE" | 20 | 20 | 20 |
| an aqueous dispersion @ 40% solids containing a combination of components including microcrystalline and paraffin waxes commercially available from Petrolite Corp., Tulsa, OK under the trade designation "Petrolite 75" | 7.5 | | |
| an aqueous emulsion of paraffin wax @ 50% solids commercially available from Mobil Oil Corp, Fairfax, VA under the trade designation "Mobilcer RV" | | 2.0 | |
| an aqueous dispersion of paraffin based wax @ 57% solids commercially available from Dominion Chemical Co., Petersburg, VA under the trade designation "DC Wax Emulsion BW-058" | | | 2.0 |
| $H_2O$ | 15 | 15 | 15 |

TABLE 2

COATING WEIGHTS FOR EXAMPLES 1–3

| Example Designation | Make Resin ($g/m^2$) | Mineral Weight ($g/m^2$) | Size Resin ($g/m^2$) |
|---|---|---|---|
| Ex. 1 | 90 | 185 | 119 |
| Ex. 2 | 90 | 185 | 133 |
| Ex. 3 | 90 | 185 | 121 |

TABLE 3

WOODSANDING NORMAL FORCE TEST

| Example Designation | Fn (NT) @ 24 cm/ 0.25 mm/pass | Total Cut cut $cm^3$/ path $cm^2$ | % of Comparative Ex. A |
|---|---|---|---|
| Comp. Ex. A | 32.0 | 9.29 | 100 |
| Ex. 1 | 31.6 | 12.86 | 138 |
| Ex. 2 | 28.2 | 14.77 | 159 |
| Ex. 3 | 29.7 | 7.84 | 84 |

The abrasive articles of Examples 1 and 2 were observed to perform for a longer period of time prior to loading and burning in comparison with the abrasive article of Comparative example A. It is believed that the wax-containing modifiers used in Examples 1 and 2 functioned to reduce the sawdust loading of the abrasive articles. Additionally, the abrasive article of Comparative example A sanded at a higher normal force than those of Examples 1 and 2, as shown in Table 3.

Examples 4–11 and Comparative Examples B–D

Modified size coat bond systems were included in the abrasive articles of Examples 4–11 and were prepared from a 75% solids phenolic resin and the materials described in Table 4. The mixture was applied over the abrasive particles/make coat construction from above via two-roll coater. The wet size coat bond system weight in each case was about 150 $g/m^2$. Examples 4–11 then received a thermal cure of 30 minutes at 88° C. followed by 12 hours at 100° C. The make coat, mineral (i.e., abrasive particles), and size coat bond system weights are listed in Table 5 for the abrasive articles of Examples 4–8 and in Table 7 for the abrasive articles of Examples 9–11.

After thermal cure, the coated abrasives were single flexed (i.e., passed over a roller at an angle of 90° to allow a controlled cracking of the make and size coatings), then converted into 7.6 cm by 168 cm coated abrasive belts.

Examples 4–8 were compared with Comparative Example B using the Woodsanding Normal Force Test, described above. The results are shown in Table 6. Particle board test conditions in Table 6 utilized 2.0 mm/pass to evaluate the antiloading durability of the abrasive belt surface.

Example 9 was compared with Comparative Example C and Examples 10 and 11 were compared with Comparative Example D using the Woodsanding Normal Force Test, described above. The results are shown in Table 8. Particle board test conditions in Table 8 utilized a downfeed of 2.0 mm/pass to evaluate the antiloading durability of the abrasive belt surface.

The downfeed sequences in Tables 6 and 8 were a constant 2.0 mm/pass. The downfeed condition of 2.0 mm/pass was continued until either the belt failed by burning and/or the normal force Fn) exceeded 445 Newtons (NT) during sanding on the narrow edge of the particle board. The particle board characteristics may vary due to the relative humidity and the season of the year.

TABLE 4

SIZE COAT FORMULATIONS FOR EXAMPLES 4–11

| Components (weight in grams) | Ex. 4/10 & 11 | Ex. 5 | Ex. 6 | Ex. 7 | Ex. 8 | Ex. 9 |
|---|---|---|---|---|---|---|
| RPl (a resole phenolic resin prepared by reacting a molar excess of formaldehyde with phenol catalyzed with caustic resulting in 75% solids) | 100 | 100 | 100 | 100 | 100 | 100 |
| 3 micron calcium carbonate filler available from ECC International, Sylacauga, AL under the trade designation "MICROWHITE" | 20 | 20 | 20 | 20 | 20 | 20 |
| an aqueous, anionic emulsion of paraffin-based wax @ 50% solids commercially available from Tirarco Chemical Co., Dalton, GA under the trade designation "OCTOWAX 695" | 1 | | | | | |
| an aqueous, anionic emulsion of paraffin and microcrystalline waxes @ 53% solids commercially available from Tirarco Chemical Co., Dalton, GA under the trade designation "OCTOWAX 437" | | 1 | | | | |
| an aqueous, anionic emulsion of paraffin-based wax @ 50% solids commercially available from Tirarco Chemical Co., Dalton, GA under the trade designation "OCTOWAX 321" | | | 1 | | | |
| Petrolite 75 (described in Table 1) | | | | 3.75 | | |
| Mobilcer RV (described in Table 1) | | | | | 2 | |
| castor wax, a solid, available from Cas Chem, Inc., Bayonne, NJ | | | | | | 1 |
| A glycol ester of fatty acid commercially available from Interstab Chemicals, Inc., under the trade designation "Interwet 33" | 0.2 | 0.2 | 0.2 | 0.2 | | 0.2 |

TABLE 4-continued

SIZE COAT FORMULATIONS FOR EXAMPLES 4–11

| Components (weight in grams) | Ex. 4/10 & 11 | Ex. 5 | Ex. 6 | Ex. 7 | Ex. 8 | Ex. 9 |
|---|---|---|---|---|---|---|
| An ethoxylated oleic acid commercially available from BASF Corp., Mount Olive, NJ, under the trade designation "Emulon A" | | | | | 0.2 | |
| $H_2O$ | 13 | 13 | 13 | 13 | 13 | 11.3 |

TABLE 5

COATING WEIGHTS FOR EXAMPLES 4–8

| Example Designation | Make Resin ($g/m^2$) | Mineral Weight ($g/m^2$) | Size Resin ($g/m^2$) |
|---|---|---|---|
| Ex. 4 | 85 | 174 | 133 |
| Ex. 5 | 85 | 174 | 128 |
| Ex. 6 | 85 | 174 | 142 |
| Ex. 7 | 85 | 174 | 119 |
| Ex. 8 | 85 | 174 | 138 |

TABLE 6

WOODSANDING NORMAL FORCE TEST

| Example Designation | Fn (NT) @ 24 cm/ 2.0 mm/pass | Total Cut cut $cm^3$/ path $cm^2$ | % of Comparative Ex. B |
|---|---|---|---|
| Comp. Ex. B | 277 | 5.32 | 100 |
| Ex. 4 | 284 | 9.75 | 183 |
| Ex. 5 | 367 | 5.43 | 102 |
| Ex. 6 | 254 | 6.52 | 123 |
| Ex. 7 | 337 | 7.57 | 142 |
| Ex. 8 | 298 | 7.09 | 133 |

The abrasive articles of Examples 4–8 were observed to perform for a longer period of time prior to loading and burning as compared with the abrasive article of 10 Comparative example B. It is believed that the wax-containing modifier and the wetting agent function to reduce the sawdust loading of the abrasive articles. It was also observed that the abrasive articles of Examples 4–8 removed more from the workpiece surface than that of Comparative example B, as shown in Table 6.

TABLE 7

COATING WEIGHTS FOR EXAMPLES 9–11

| Example Designation | Make Resin ($g/m^2$) | Mineral Weight ($g/m^2$) | Size Resin ($g/m^2$) |
|---|---|---|---|
| Ex. 9 | 100 | 205 | 128 |
| Ex. 10 | 94 | 196 | 121 |
| Ex. 11 | 94 | 196 | 142 |

TABLE 8

WOODSANDING NORMAL FORCE TEST

| Example Designation | Fn (NT) @ 24 cm/ 2.0 mm/pass | Total Cut cut $cm^3$/ path $cm^2$ | % of Comparative Ex. C or D |
|---|---|---|---|
| Comp. Ex. C | 429 | 3.41 | 100 |
| Ex. 9 | 247 | 14.32 | 420 |
| Comp. Ex. D | 445 | 5.52 | 100 |
| Ex. 10 | 369 | 7.20 | 131 |
| Ex. 11 | 151 | 19.75 | 358 |

The abrasive articles of Examples 9–11 were observed to perform for a longer period of time prior to loading and burning as compared with the abrasive 10 article of Comparative examples C and D. The data in Table 8 demonstrate that the wax-containing modifier of castor wax in the abrasive article of Example 9 performed about four times better than Comparative example C. The data also shows that the abrasive article of Example 11 (having a thicker size coat) demonstrated improved total cut than Comparative example D.

Patents and patent applications disclosed herein are hereby incorporated by reference as if individually incorporated. It is to be understood that the above description is intended to be illustrative, and not restrictive. Various modifications and alterations of this invention will become apparent to those skilled in the art from the foregoing description without departing from the scope and the spirit of this invention, and it should be understood that this invention is not to be unduly limited to the illustrative embodiments set forth herein.

What is claimed is:

1. An abrasive article comprising:

a backing having a first major surface and a second major surface;

a plurality of abrasive particles;

at least one bond system formed from a composition comprising a binder precursor and about 15% by weight or less of a wax-containing modifier wherein the bond system adheres the plurality of abrasive particles to the first major surface of the backing.

2. The abrasive article of claim 1 wherein the wax-containing modifier is present in an amount of about 0.1% by weight to about 5.0% by weight.

3. The abrasive article of claim 2 wherein the wax-containing modifier is present in an amount of about 0.5% by weight to about 3.0% by weight.

4. The abrasive article of claim 1 wherein the wax-containing modifier comprises a wax selected from the group of a paraffin wax, a microcrystalline wax, a castor wax, a beeswax, a carnauba wax, a Fischer-Tropsch wax, a polyethylene wax, an ouricuri wax, a ceresin wax, a polyolefin wax, an amide wax, and a mixture thereof.

5. The abrasive article of claim 4 wherein the wax-containing modifier comprises a wax dispersion.

6. The abrasive article of claim 1 wherein the plurality of abrasive particles and the at least one binder system together comprise a plurality of precisely shaped composites on the first major surface of the backing.

7. The abrasive article of claim 1 wherein the binder precursor selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

8. The abrasive article of claim 1 wherein the binder precursor comprises a phenolic resin.

9. The abrasive article of claim 1 wherein the at least one bond system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

10. An abrasive article comprising:

a backing having a first major surface and a second major surface;

a plurality of abrasive particles;

a make coat bond system formed from a first binder precursor, wherein the make coat bond system bonds the plurality of abrasive particles to the first major surface of the backing;

a size coat bond system formed from a composition comprising a second binder precursor and about 15% by weight or less of a wax-containing modifier, wherein the size coat bond system forms at least a portion of a peripheral surface of the abrasive article.

11. The abrasive article of claim 10 wherein the wax-containing modifier is present in an amount of about 0.1% by weight to about 5.0% by weight.

12. The abrasive article of claim 11 wherein the wax-containing modifier is present in an amount of about 0.5% by weight to about 3.0% by weight.

13. The abrasive article of claim 10 wherein the wax-containing modifier comprises a wax selected from the group of a paraffin wax, a microcrystalline wax, a castor wax, a beeswax, a camauba wax, a Fischer-Tropsch wax, a polyethylene wax, an ouricuri wax, a ceresin wax, a polyolefin wax, an amide wax, and a mixture thereof.

14. The abrasive article of claim 10 wherein the wax-containing modifier comprises a wax dispersion.

15. The abrasive article of claim 10 wherein the second binder precursor selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

16. The abrasive article of claim 15 wherein the second binder precursor comprises a phenolic resin.

17. The abrasive article of claim 10 wherein the size coat bond system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

18. The abrasive article of claim 10 wherein the abrasive article exhibits an increase in total cut in a Woodsanding Normal Force Test as compared to an abrasive article including a size coat bond system formed from a composition containing substantially no wax-containing modifier.

19. An abrasive article comprising:

a backing having a first major surface and a second major surface;

a plurality of abrasive particles;

a make coat bond system formed from a first binder precursor, wherein the make coat bond system bonds the plurality of abrasive particles to the first major surface of the backing;

a size coat bond system formed from a composition comprising a second binder precursor and a wax-containing modifier in an amount of about 0.1% weight percent to about 5% by weight, wherein the size coat bond system forms at least a portion of a peripheral surface of the abrasive article.

20. The abrasive article of claim 19 wherein the wax-containing modifier comprises a wax selected from the group of a paraffin wax, a microcrystalline wax, a castor wax, a beeswax, a camauba wax, a Fischer-Tropsch wax, a polyethylene wax, an ouricuri wax, a ceresin wax, a polyolefin wax, an amide wax, and a mixture thereof.

21. The abrasive article of claim 19 wherein the wax-containing modifier comprises a wax dispersion.

22. The abrasive article of claim 19 wherein the second binder precursor selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

23. The abrasive article of claim 22 wherein the second binder precursor comprises a phenolic resin.

24. The abrasive article of claim 19 wherein the size coat bond system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

25. The abrasive article of claim 19 further comprising a peripheral coating formed from a third binder precursor, wherein the peripheral coating is formed on the size coat bond system.

26. An abrasive article comprising:

a backing having a first major surface and a second major surface;

a plurality of abrasive particles;

a make coat bond system formed from a first binder precursor, wherein the make coat bond system bonds the plurality of abrasive particles to the first major surface of the backing;

a peripheral coat bond system wherein the peripheral coat is present over the size coat formed from a composition comprising:

a phenolic resin binder precursor; and a wax-containing modifier in an amount of about 0.5% weight percent to about 3% by weight, wherein the wax-containing modifier comprises a wax selected from the group of a paraffin wax, a microcrystalline wax, a castor wax, a beeswax, a carnauba wax, a Fischer-Tropsch wax, a polyethylene wax, an ouricuri wax, a ceresin wax, a polyolefin wax, an amide wax, and a mixture thereof.

27. The abrasive article of claim 26 wherein the wax-containing modifier comprises a wax dispersion.

28. The abrasive article of claim 26 wherein the peripheral coating is selected from the group of a size coat and a supersize coat.

29. The abrasive article of claim 26 wherein the peripheral coat bond system is formed from a composition further comprising an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

30. A method for making a coated abrasive article, comprising the steps of:

applying a first binder precursor to a substrate;

at least partially embedding a plurality of abrasive particles in the first binder precursor;

at least partially curing the first binder precursor;

applying a composition formed by blending a second binder precursor and about 15% by weight or less of a wax-containing modifier over the at least partially cured first binder precursor and the plurality of abrasive particles; and curing the second binder precursor.

31. The method of claim 30 wherein the wax-containing modifier is present in an amount of about 0.1% by weight to about 5.0% by weight.

32. The method of claim 31 wherein the wax-containing modifier is present in an amount of about 0.5% by weight to about 3.0% by weight.

33. The method of claim 30 wherein the wax-containing modifier comprises a wax selected from the group of a paraffin wax, a microcrystalline wax, a castor wax, a beeswax, a carnauba wax, a Fischer-Tropsch wax, a polyethylene wax, an ouricuri wax, a ceresin wax, a polyolefin wax, an amide wax, and a mixture thereof.

34. The method of claim 30 wherein the wax-containing modifier comprises a wax dispersion.

35. The method of claim 30 wherein the second binder precursor selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

36. The method of claim 30 wherein the second binder precursor comprises a phenolic resin.

37. The method of claim 30 wherein the composition further comprises an optional additive selected from the group of a filler, a fiber-containing material, an antistatic agent, a lubricant, a wetting agent, a surfactant, a pigment, a dye, a coupling agent, a plasticizer, a release agent, a suspending agent, a curing agent, and a compatible mixture thereof.

38. The method of claim 30 further comprising the steps of:

applying an intermediate binder precursor over the at least partially cured first resin precursor and the plurality of abrasive particles; and at least partially curing the intermediate binder precursor prior to applying the composition formed by blending a second resin precursor and about 15% by weight or less of a wax-containing modifier.

39. The method of claim 38 wherein the intermediate binder precursor is selected from the group of a phenolic resin, an aminoplast resin having pendant α,β-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and a mixture thereof.

40. The method of claim 39 wherein the intermediate binder precursor comprises a phenolic resin binder precursor.

41. A method of reducing a surface of a workpiece comprising the steps of:

frictionally engaging a peripheral surface of an abrasive article with a surface of a workpiece, wherein the abrasive article comprises:

a backing having a first major surface and a second major surface;

a plurality of abrasive particles;

at least one bond system formed from a composition comprising a binder precursor and about 15% by weight or less of a wax-containing modifier, wherein the bond system bonds the plurality of abrasive particles to the first major surface of the backing; and moving the abrasive article and the workpiece relative to each other such that the surface of the workpiece is reduced.

42. A method of using an abrasive article to reduce a surface of a workpiece comprising the steps of:

frictionally engaging a peripheral surface of an abrasive article with a surface of a workpiece, wherein the abrasive article comprises:

a backing having a first major surface and a second major surface;

a plurality of abrasive particles;

a make coat bond system formed from a first binder precursor, wherein the make coat bond system bonds the plurality of abrasive particles to the first major surface of the backing; and a size coat bond system present over the abrasive particles on at least a portion of the plurality of the abrasive particles forming at least a portion of the peripheral surface, wherein the size coat bond system is formed from a composition comprising a second binder precursor and about 15% by weight or less of a wax-containing modifier; and moving the abrasive article and the workpiece relative to each other such that the surface of the workpiece is reduced.

43. A method of using an abrasive article to reduce a surface of a workpiece comprising the steps of:

frictionally engaging a peripheral surface an abrasive article with a surface of a workpiece, wherein the abrasive article comprises:

a backing having a first major surface and a second major surface;

a plurality of abrasive particles;

a make coat bond system formed from a first binder precursor, wherein the make coat bond system bonds the plurality of abrasive particles to the first major surface of the backing;

a size coat bond system present over the abrasive particles on at least a portion of the plurality of the abrasive particles forming at least a portion of the peripheral surface, wherein the size coat bond system is formed from a composition comprising a second binder precursor and a wax-containing modifier in an amount of about 0.1% weight percent to about 5% by weight of the composition forming the size coat bond system; and moving the abrasive article and the workpiece relative to each other such that the surface of the workpiece is reduced.

44. A method of using an abrasive article to reduce a surface of a workpiece comprising the steps of:

frictionally engaging a peripheral surface of a peripheral surface of an abrasive article with a surface of a workpiece, wherein the abrasive article comprises:

a backing having a first major surface and a second major surface;

a plurality of abrasive particles;

a make coat bond system formed from a first binder precursor, wherein the make coat bond system bonds the plurality of abrasive particles to the first major surface of the backing;

a peripheral coat bond system present over the abrasive particles on at least a portion of the plurality of the abrasive particles forming at least a portion of the peripheral surface, wherein the peripheral coat bond system is formed from a composition comprising:

a phenolic resin binder precursor; and a wax-containing modifier in an amount of about 0.5% weight percent to about 3% by weight, wherein the wax-containing modifier comprises a wax selected from the group of a paraffin wax, a microcrystalline wax, a castor wax, a beeswax, a carnauba wax, a Fischer-Tropsch wax, a polyethylene wax, an ouricuri wax, a ceresin wax, a polyolefin wax, an amide wax, and a mixture thereof; and moving the abrasive article and the workpiece relative to each other such that the surface of the workpiece is reduced.

* * * * *